United States Patent [19]

Poppinga et al.

[11] 3,986,472

[45] Oct. 19, 1976

[54] NAVIGATING BRIDGE FOR SEAGOING VESSELS

[76] Inventors: Ubbe Poppinga, Estebogen 33, 2101 Hamburg 96; Jürgen Töllner, Uckerstr. 39, 2000 Hamburg 53; Georg Martinsteg, Schaferkamp 2a, 2000 Hamburg-Schenefeld, all of Germany

[22] Filed: Oct. 21, 1974

[21] Appl. No.: 516,622

[30] Foreign Application Priority Data

Oct. 22, 1973 Germany ..... 2352933

[52] U.S. Cl. ..... 114/.5 R; 114/66

[51] Int. Cl.[2] ..... B63B 35/00

[58] Field of Search ..... 114/.5 R, 66, 71, 189; 115/.5 R; 244/188 P, 83 F

[56] References Cited

OTHER PUBLICATIONS

"Hitachi–Built" Tankers; Mar. 1973; *The Motor Ship;* pp. 524–526.

"Aalborg–Buit" Carries; Apr. 1973; *The Motor Ship;* pp. 27–33.

"Eriksberg–Built" Vessels; July 1973; *The Motor Ship;* pp. 165–169.

*Primary Examiner*—Trygve M. Blix
*Assistant Examiner*—Stuart M. Goldstein
*Attorney, Agent, or Firm*—Charles Hieken; Jerry Hieken

[57] ABSTRACT

The present invention relates to a navigating bridge for seagoing vessels with a panorama-deckhouse and a central action station with a concentration of all means necessary for observation and operation within the range of the operator in charge. There are port and starboard workplaces with port and starboard chairs, respectively, and a U-like navigating desk embracing the port and starboard workplaces having a front console and adjoining starboard and port side consoles. The port and starboard chairs are mounted for movement on port and starboard rails, respectively, in the first and second workplaces, respectively. There is a middle console located between the first and second rails adjoining the middle part of the front console. The height of the chairs relative to that of the consoles is high enough so that a person seated in either of the chairs has a clear view over all the consoles. The vehicle steering gear may be controlled at the aft portion of the middle console from a third workplace. A central optical bearing device and a gyropilot repeater compass may be arranged in the fore and aft parts, respectively, of the middle console. A radar indicator on the front console is movable between an upper operating position and a low rest position. The front console includes a table-like work surface, including a chart table. The navigating desk and other locations on the navigating bridge include devices for attendance reply. The navigating bridge includes port and starboard wings each having a fore edge that forms an acute angle of more than 45° with the fore-aft axis of the vessel and port and starboard corner windows ahead of the junction between the port and starboard wing leading edges, respectively, with the panorama-deckhouse.

12 Claims, 3 Drawing Figures

NAVIGATING BRIDGE FOR SEAGOING VESSELS

STATE OF ART

Figure 1:
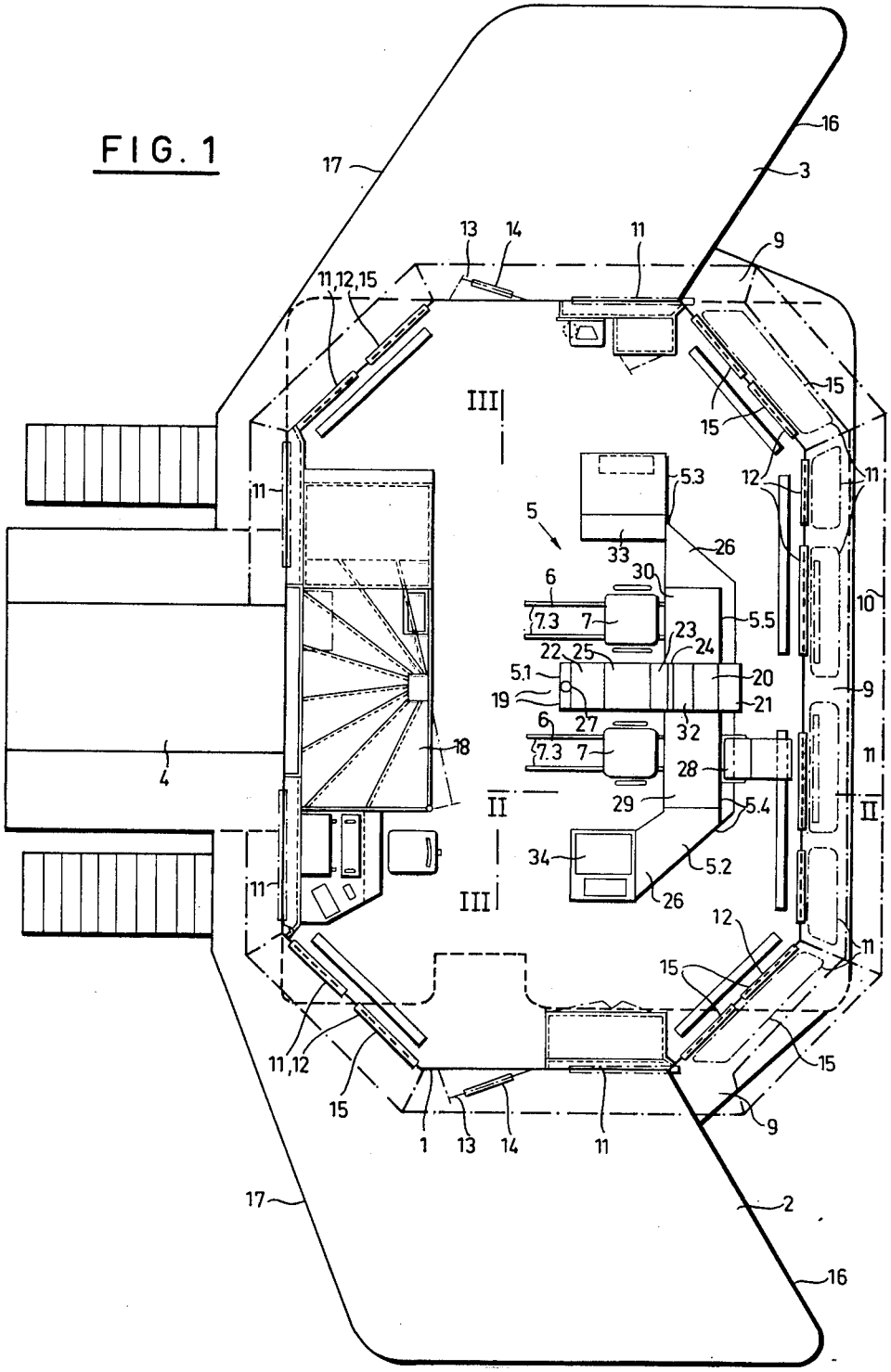

In practice bridges for seagoing ships hitherto are constructed on the basis of a division into three spatially and functionally separated areas according to the three most important ranges of work, namely bridge action station, chartroom and radio operation station.

Moreover proposals have been made to evolve a bridge for one-man navigation of seagoing ships provided with two side by side workplaces which are surrounded by an U-like switch desk with a front desk and two consoles or side desks.

The space between the workplaces — it is true — in this proposed one-man action station shall be reserved for the control means of the steering gear, in order to be operable likewise from one or the other workplace. Apart from this the means for observation and operation or control are arranged in such a manner that only one of both workplaces is the main workplace of full value, whereas the other is a secondary or auxiliary workplace and is assumed to be used by the helmsman or the captain for assistance or supervision of the navigating operator or for training by persons of the junior set. Moreover the division of labour for the both workplaces is unclear and the switch desk is constructed for doing the work of observation and operation in sitting and not in stand-up position. The sight from the workseats, however, is restricted by the high front desk, so that the operator is required to stand up in order to observe the area beneath the horizontal line of sight.

Presumably for these reasons this proposal for one-man action stations has not gained entry into practice. The above-mentioned bridge consisting of three separated work areas, however, has the disadvantage of a high space requirement and cannot give the desired total survey by one man if necessary or desired. The spacious deckhouse which is necessary for this conventional multisectional navigating bridge makes impossible a good view all around and affords the simultaneous operation of several persons for a secure navigation on seagoing vessels. Besides it is difficult to ensure a good survey and coordination of the activities of the several workers on account of the essential spatial separation of their workplaces.

PROBLEM

It is an object of the present invention to provide a navigating bridge for seagoing ships which according to the above mentioned draft may enable one-man navigation, which, however avoids the disadvantages of said proposed one-man navigating bridges.

THE INVENTION

For the solution of this problem, the present invention proceeds from the consideration that an one-man navigating bridge for reason of security should be provided with a second workplace and that this second workplace — unlike that in the already proposed one-man navigating bridge — should be given not merely an auxiliary function. All means which are important for navigation should be coordinated equally to both workplaces just as is the case in an airliner having positions for "pilot and copilot." In the development of such a navigating bridge the inventors partly could make use of the modern engineering of inland navigation with its known navigating bridge having two equally equipped workplaces at opposite sides of a middle switch desk.

That such a "pilot and copilot"—navigating bridge has not been adopted for seagoing vessels may be due to the fact that in sea navigation several additional criteria must be taken into account which result from the different conditions and regulations of navigation at sea and which have given rise to the development of special equipments, like gyrocompass and bearing device, in three spatially as well as functionally separated stations and their coordination by corresponding means of communication. Now, a strict investigation of all circumstances, especially in connection with the one-man watch which — in the face of conflicting authoritative regulations — often is practised in periods of low traffic, has shown that in spite of and just on account of the enlarged volume of functions, equipments and regulations it is possible and important to come to a navigating bridge for seagoing vessels which is just as easy to survey as since long time is the case with navigating bridges of inland navigation.

Following from this appreciation of the problem, the solution according to the present invention consists in that two essentially uniform workplaces are arranged side by side which are provided with independently mobile high wheel chairs and have panorama sight from a relative small cockpitlike deckhouse, and that all important means for observation and control — instead of in a high front desk — are arranged in three consoles or side desks, namely a middle side desk between both workplaces and a starbord and port desk respectively at the outsides whereby those important navigation means which are installed in the outside desks are made in double and synchronous disposition and that said high chairs, switch desk and deckhouse are constructed and arranged relative to one another in such a manner that if two watches simultaneously are present in the first and second workplaces respectively both watches according to the principle "pilot and copilot" are in all around sight position all the same whether they occupy their workplace in stand-up or sitting position and all important navigating means are in optimal placement for observation and operation by both watches.

On seagoing vessels it is customary to provide a separate workplace for the helmsman which shall be in action as third man if it is desired to meet the most exacting demands.

In the afore mentioned one-man action stations the second of the two side by side workplaces was used for the helmsman. We know, however, from experience, that it is desirable to keep free the second workplace so that it may be used by the pilot or by the captain. In order to enable such a close co-operation of the watch and the captain or pilot the inventors have provided a third workplace at the backside of the switch desk and preferably at the backside of the middle side desk including operating members which are synchronized to corresponding operating members in the fore part of the action station.

As already has been discussed above, the front part of the action station should be kept free largely and especially is suitable for the arrangement of a working table preferably of a card or chart table.

The security of ships naturally is contingent on the uninterrupted attentiveness of the watch, even if the ship has a most perfect navigation system. This is true to a higher degree if the watch is done by a single person. In order to comply with these requirements a device for attendance reply is provided within the action station which gives the alarm as soon as its control of the watch indicates a failure or a discontinuance of the regular watching activity. In order to facilitate the work especially if the watch is done by a single person, it is useful to provide several actuating elements at different spots of the navigating bridge.

In connection with the device for attendance reply the new cockpit-like deckhouse with its action station gives a better security than the customary large navigating bridges of seagoing ships which are designed on principle for operation by several operators and that especially because these known bridges often — in nonconformity with their organisation — are operated by only one man.

DESCRIPTION OF AN EMBODIMENT

Figure 2:
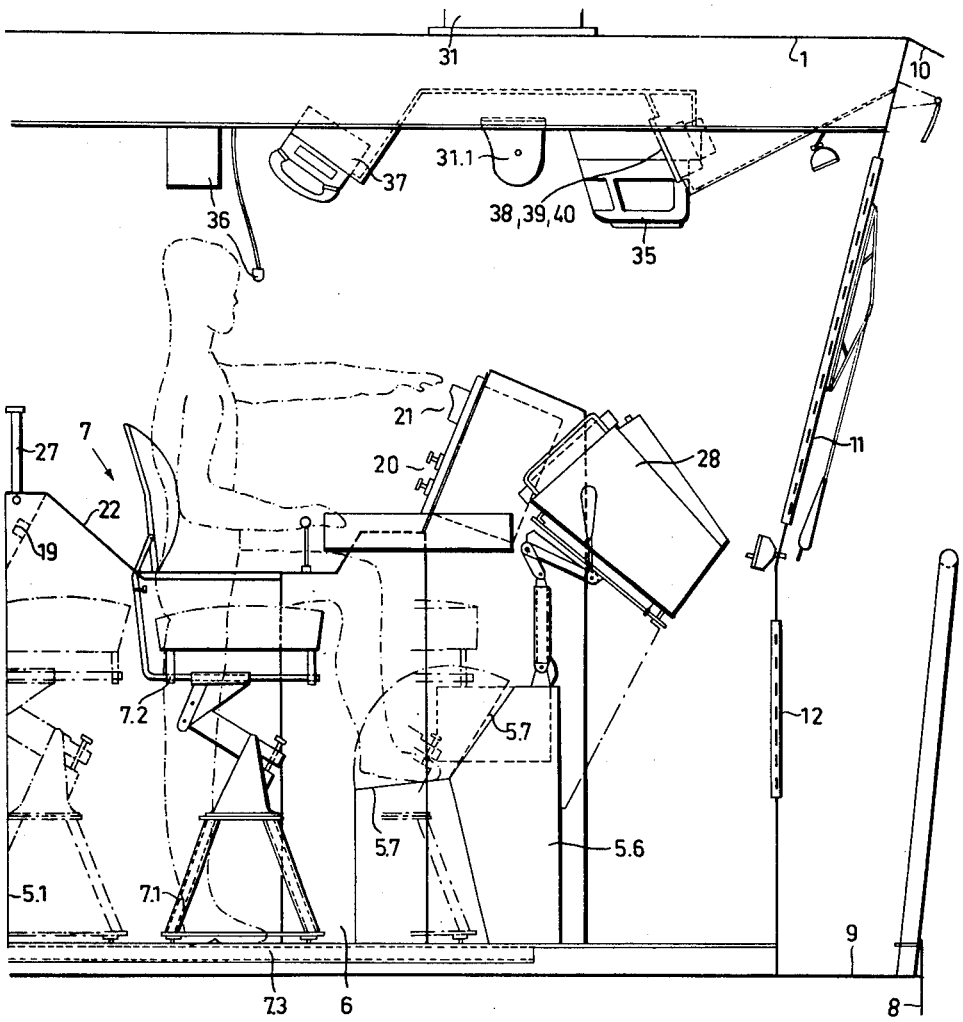
Figure 3:
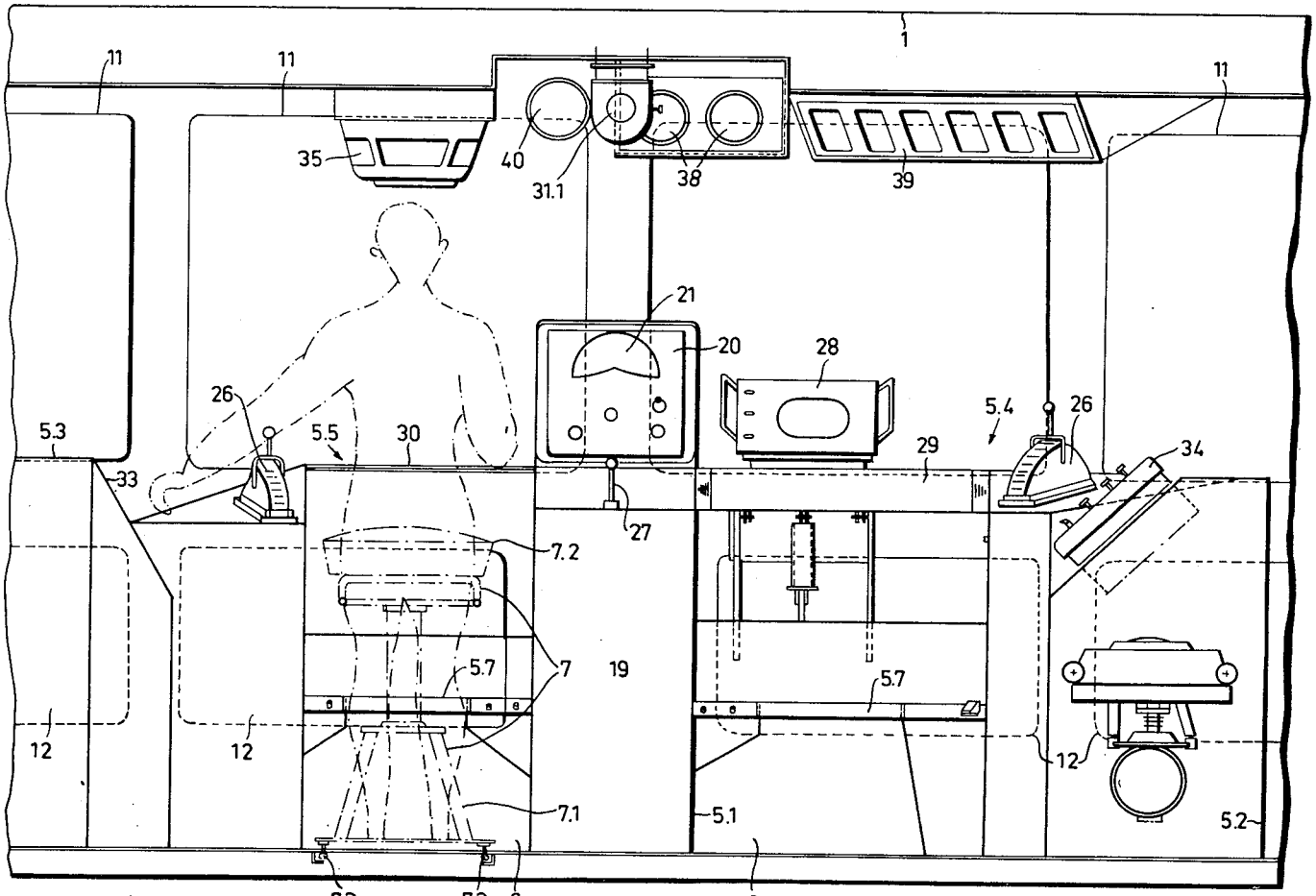

For a better understanding of the present invention an embodiment thereof will now be described in more detail with reference to the accompanying drawings, in which:

FIG. 1 is a plan view of a navigating bridge with a horizontal section through the deckhouse beneath the window parapet and illustration of its upper part by dotted lines, FIG. 2 a partial square section along line II—II of FIG. 1 and FIG. 3 a partial square section along line III—III of FIG. 1.

The bridge shown in the drawings includes a deckhouse 1, which is arranged in front of the funnel 4 on the upper deck with the starbord wing 2 and the port wing 3. The deckhouse 1 is in the shape of a cockpit with panorama sight and has a central action station with switch desk 5. The switch desk includes all means for observation and operation or control which are arranged within the radius of work of the watch men when present on their workplaces.

The action station is provided with two workplaces 6,6 which on principle are of equal value similar to the workplaces of pilot and copilot in cockpits of airplanes. All means which are important for navigation are equally coordinated to each of both workplaces. Each workplace is provided with a high chair 7 which has wheels and is movable forward or backward. Switch desk and high chairs are arranged so that the watch in stand-up or sitting position is able to look over the desk and through the windows all around, all devices for navigation being situated within the optimal area for observation and operation, and that equally for both workplaces. The important devices for operation or attendance are arranged on both sides of both workplaces namely in a middle console of the switch desk or middle side desk 5.1, a starbord console or right outer side desk 5.2 and a port console or left outer side desk 5.3. Said three consoles are connected with one another by a frontdesk consisting of a starbord front desk 5.4 and a port front desk 5.5.

The two front desks are designed as working tables namely as small chart table on the starbord side and as writing-table on the port side. Moreover the three consoles are connected by a channel 5.6 within the front desk which channel especially is provided for the reception of means for the connection of devices which are arranged in double equipment namely the first in the right and the second in the left outer side desk. Foot rests 5.7 are installed beneath the work tables 5.4 and 5.5.

The high station seats each consist of a chair support 7.1 and a chair 7.2 of normal height which is detachably mounted on the support and they are movable longitudinally on rails 7.3. The combination of a support and a chair of normal height makes it possible to take advantage of the rich offer of chairs especially of high technical standard and thus to enable a good accommodation to the specific circumstances and requests.

The deckhouse is reset relative to the fore front 8 of the upper deck and the margin 9 of the upper deck between said front 8 and the deckhouse 1 is designed as control passage for the front of the deckhouse and especially for the front windows. Thereby the eaves 10 of the deckhouse form a roof for the control passage 9.

The deckhouse is provided with an upper row of windows 11 which is continuous with exception of the place of the funnel 4. A corresponding low row of windows 12 is provided below the window parapet, including glazed cut-outs 14 in the doors 13 of the deckhouse. For an optimal sight through the lower windows the action station 5 may be arranged free-standing in the deckhouse.

Corner windows 15 are provided which are arranged at a right angle to the direction of sight from the action station 5.

The front limits 16 and rear limits 17 of the wings 2,3 are arranged so that the wings and the bulwarks are outside the area of sight through the corner windows and especially through the fore corner windows 15 and the fore bulwarks 16 of the wings 2,3 are extending in direction of sight from the workplaces 6,6 and preferably from a third work place 19. Such a third workplace 19 for the helmsman is provided at the backside of the middle side desk or console 5.1 including coordinated operating members which are synchronized to corresponding operating elements in the fore part of the action station.

Devices which if arranged in the outer consoles would afford double equipment preferably are arranged in the middle console 5.1. This is true especially for the gyropilot 20 with its repeator compass 21. Moreover a tableau for survey, of engines, the operating device for the steering gear and the most important means for communication 25 are installed in the middle console. In order to design the action station optimally for operation by both hands of the operators the control panels 26,26 for the driving engines are not arranged together with the steering gear control in the middle console but in the outer consoles 5.2 and 5.3. Of course, the steering gear control could be performed by synchronized double devices within the outer consoles whereas a single control panel for the driving engines then would be arranged in the middle console.

Utilizing the good panorama sight from the action station a place for bearing is provided within the deckhouse. Only the tripod 27 is shown in the drawing which the bearing device in a usual manner may be attached. The tripod or bearing device 27 like the third work place 19 is arranged at the back of the middle console so that the repeater compass 21 is within the sight area of the operator of the bearing device.

A radar indicator 28 is arranged at the front of the starbord workplace 6 and is sinkable in order to avoid an impairment of the free sight when the radar indicator is not used. For the same reason the worktables 29,30 could be movable into a lower rest position.

Other devices for navigation such as the mirror 31.1 of a bearing-reflection-compass 31, steering indicator 35, communicator 36, radio set 37, revolution indicator 38, manometer 39 and clinometer 40 are arranged at the ceiling of the deckhouse.

An attendance reply 32 is installed in the action station 5 which is designed in such a manner that it is to be operated by the watch within certain intervalls in order to ensure that the watch service is done without inadmissible interruptions.

Devices for observations only may be arranged in single equipment in one of the outer consoles provided they are arranged in such a manner that they easily may be observed from both workplaces 6,6 and preferably also from the workplace 19. This is true for instance for an echo depth sounder 34 and a tableau 33 for watching over navigation lights and the lighting system, which are arranged in surfaces of corresponding inclination.

We claim:

1. In a navigating bridge for seagoing vessels including a panorama-deckhouse with first and second workplaces arranged side by side with first and second chairs respectively, a U-shaped navigating desk embracing said first and second workplaces having a front console and adjoining starboard and port side consoles the improvement comprising, first and second rails in said first and second workplaces respectively, means for supporting said first and second chairs for movement generally fore and aft on said first and second rails respectively, a middle console located between said first and second rails and adjoining the middle part of said front console, the height of said chairs relative to that of said consoles being great enough so that a person seated in either of said chairs has a clear view over all said consoles.

2. The improvement according to claim 1 and further comprising, a control means for the vessel steering gear in said middle console, the aft portion of said middle console comprising means defining a third workplace.

3. the improvement according to claim 1 and further comprising, a central optical bearing device arranged in said middle console.

4. The improvement according to claim 3 and further comprising a gyropilot repeater compass arranged in the fore part of said middle console with said central optical bearing device in the aft part of said middle console.

5. The improvement according to claim 1 and further comprising at least one radar indicator movable between an upper operating position and a low rest position on said front console.

6. The improvement according to claim 1 wherein said front console includes a table-like work surface.

7. The improvement according to claim 6 wherein said front console includes a chart table.

8. The improvement according to claim 1 and further comprising a device for attendance reply arranged in said navigating desk.

9. The improvement according to claim 1 and further comprising a plurality of devices for attendance reply arranged at different places of said navigating bridge.

10. The improvement according to claim 1 wherein said navigating bridge includes port and starboard wings each having a fore edge that forms an acute angle of more than 45° with the fore-aft axis of the vessel.

11. The improvement according to claim 10 and further comprising port and starboard corner windows ahead of the junction between the port and starboard wing leading edges respectively with said panorama-deckhouse.

12. The improvement according to claim 1 and further comprising, a gyropilot with its repeater compass, a tableau for survey of machinery and means for communication arranged in said middle console, and a device for steering control or the control panel for the driving engines arranged in each of said port and starboard side consoles so that operation of the steering control in either side console controls steering and operation of the control panel for the driving engines in either side console controls the driving engines.

* * * * *